US008683938B2

(12) United States Patent
Shoda et al.

(10) Patent No.: US 8,683,938 B2
(45) Date of Patent: Apr. 1, 2014

(54) UNDERWATER POSTURE STABILIZATION SYSTEM AND DIVING APPARATUS EQUIPPED WITH THE SAME

(75) Inventors: Akihito Shoda, Minato-ku (JP); Tohru Harada, Minato-ku (JP); Ikuo Yamamoto, Kitakyushu (JP); Kazuo Ishii, Kitakyushu (JP); Amir Ali Forough Nassiraei, Kitakyushu (JP)

(73) Assignee: Kitakyushu Foundation for the Advancement of Industry, Science and Technology, Kitakyushu-shi (JP)

( * ) Notice: Subject to any disclaimer, the term of this patent is extended or adjusted under 35 U.S.C. 154(b) by 406 days.

(21) Appl. No.: 12/999,443

(22) PCT Filed: Jun. 19, 2009

(86) PCT No.: PCT/JP2009/002811

§ 371 (c)(1),
(2), (4) Date: Dec. 16, 2010

(87) PCT Pub. No.: WO2009/154006

PCT Pub. Date: Dec. 23, 2009

(65) Prior Publication Data

US 2011/0094433 A1 Apr. 28, 2011

(30) Foreign Application Priority Data

Jun. 20, 2008 (JP) ..... 2008-162442

(51) Int. Cl.
*B63G 8/14* (2006.01)

(52) U.S. Cl.
USPC ..... 114/330; 114/312

(58) Field of Classification Search
USPC ..... 114/330, 123, 312–342, 124, 39.23, 114/61.15–61.19, 344; 405/186–194; 440/17–20, 25, 98
See application file for complete search history.

(56) References Cited

U.S. PATENT DOCUMENTS 6,070,544 A * 6/2000 Finley ..... 114/61.1

FOREIGN PATENT DOCUMENTS

CN 2491328 Y 5/2002
CN 2767321 Y 3/2006

(Continued)

OTHER PUBLICATIONS

International Search Report dated Sep. 15, 2009 in PCT/JP09/002811 filed Jun. 19, 2009.

(Continued)

*Primary Examiner* — Edwin Swinehart
(74) *Attorney, Agent, or Firm* — Oblon, Spivak, McClelland, Maier & Neustadt, L.L.P.

(57) ABSTRACT

Provided is an underwater posture stabilization system which, by being attached to various underwater equipment such as undersea equipment and underwater vehicles having different shapes and positions of the center of gravity according to their purpose and the like, allows simply and reliably setting their posture in water (basic posture), is excellent in versatility, is not only excellent in posture stability since, when the posture inclines under the effect and the like of tidal currents and pulsating currents, a moment to restore the posture to its original posture naturally acts, but is also capable of easily changing the posture as needed, and also is capable of stably controlling the posture even in the presence of complicated tidal currents and pulsating currents, and is excellent in reliability, stability, and certainty of posture control. The underwater posture stabilization system includes a frame to be attached to an apparatus body of the underwater equipment, a pair of sliding portions arranged so as to be freely movable back and forth on both side portions of the frame, a support member freely movable up and down which is fixed at a lower end thereof to each sliding portion, and arranged upward or obliquely upward, and a floating body arranged at a tip of each support member.

7 Claims, 8 Drawing Sheets

(56) References Cited

FOREIGN PATENT DOCUMENTS

| | | |
|---|---|---|
| EP | 0967146 | 12/1999 |
| GB | 2 433 054 A | 6/2007 |
| JP | 36 11373 | 7/1961 |
| JP | 2 216389 | 8/1990 |
| JP | 04 100993 | 9/1992 |
| JP | 09 24895 | 1/1997 |
| JP | 10 7083 | 1/1998 |
| JP | 2005 75009 | 3/2005 |
| JP | 2006 224863 | 8/2006 |

OTHER PUBLICATIONS

Office Action issued Dec. 4, 2012, in Chinese Patent Application No. 200980121795.9 with English translation of category of cited documents.

Extended European Search Report Issued May 3, 2013 in Patent Application No. 09766454.4.

* cited by examiner

UNDERWATER POSTURE STABILIZATION SYSTEM AND DIVING APPARATUS EQUIPPED WITH THE SAME

TECHNICAL FIELD

The present invention relates to an underwater posture stabilization system for stabilizing the underwater posture of various underwater equipment such as submersibles, underwater robots, and scuba diving equipment to be used for imaging and exploration in water and at the bottom of seas and oceans, rivers, lakes and marshes, dams, etc., ship bottom surveys, and the like and a diving apparatus equipped with the same.

BACKGROUND ART

Conventionally, diving apparatuses such as unmanned and manned submersibles and underwater robots that, for surveys of seas and oceans, rivers, lakes and marshes, dams, etc., and inspections of vessels such as shrouds of nuclear power plants, water tanks, and tanks, etc., and the like, perform information detection in water and at the bottom of a body of water and inspections, repair, and the like of target sites have been used. Moreover, scuba diving equipment equipped with an oxygen tank, regulator, and the like have been known as diving apparatuses which persons wear, wearing the diving apparatuses allow persons to dive, and the diving apparatuses have been used for performing imaging and exploration in water and at the bottom of a body of water and the like.

In order to prevent an image imaged by a camera, a video camera, or the like from blurring or shaking during low-speed traveling and during suspension in such diving apparatuses, and allow a fixed point observation using an environmental sensor, a variety of techniques for stably controlling posture have been developed.

As a conventional technique, there has been disclosed in (Patent Literature 1) "a method for stabilizing the posture of undersea equipment by jetting a fluid from a plurality of jet nozzles based on information from a sensor such as an inclinometer provided in undersea equipment to manipulate the posture of undersea equipment."

There has been disclosed in (Patent Literature 2) "an apparatus for controlling the position and posture of an underwater vehicle including comparison means that compares the position and posture of an underwater vehicle with the position and posture detected by an inertial sensor, and thruster rotation amount control means that controls thrust by a thruster based on a comparison result by the comparison means."

CITATION LIST

Patent Literature

Patent Literature 1: Japanese Published Unexamined Patent Application No. H09-24895

Patent Literature 2: Japanese Published Unexamined Patent Application No. 2006-224863

SUMMARY OF INVENTION

Technical Problem

However, the above-mentioned conventional techniques have had the following problems.

(1) Since the techniques disclosed in (Patent Literature 1) and (Patent Literature 2) are both for controlling the posture by jetting a fluid or rotating a thruster based on information of an inclinometer or an inertial sensor, there is a time lag after detecting position information or posture information until activating the thruster or the like to change the position or posture, and thus posture control has been difficult in the presence of complicated tidal currents and pulsating currents. Therefore, these techniques can be used only in lakes and marshes, dams, etc., with a small and gentle current, and there has been a problem of a lack of versatility.

(2) Since the undersea equipment and underwater vehicles have different shapes and positions of the center of gravity according to their purpose and the like, designing complex control systems individually has been necessary. Therefore, there has been a problem that designing control systems is troublesome and takes many man-hours.

(3) With the sophistication and downsizing of batteries to be mounted on submersibles, downsized submersibles have been designed and manufactured. Since the more the submersible is downsized, the more difficult it is to change the center of gravity or center of buoyancy position by a buoyancy control device built in the submersible, there has been a problem that the stability of the posture is reduced during low-speed traveling and during suspension. Moreover, due to high-definition underwater imagers such as cameras and video cameras that image the states in water, a large amount of information has come to be obtained, but since an image is blurred and a clear image with a high resolution cannot be obtained when shaking occurs during imaging, there has been a problem in reducing the amount of information that can be obtained. Therefore, it has been demanded to establish a technique that allows stably maintaining the posture during imaging.

(4) A submersible is generally mounted with an angle control device for raising and lowering the bow in water to keep its angle constant. As an angle control device, for example, one including a long lead screw arranged across the front and rear direction of the inside of a submersible body, a control weight provided therethrough with the lead screw and formed with a female screw screwed with the lead screw, and a motor for rotating the lead screw is used. The motor is driven to rotate the lead screw to thereby move the control weight back and forth, and raise and lower the bow, so that its angle can be kept constant. However, since the control weight must be mounted on the submersible body, this has been an obstacle in reducing the weight of the submersible, and has also been an obstacle in downsizing the submersible.

The present invention has been made for solving the conventional problems described above, and an object thereof is to provide an underwater posture stabilization system which, by being attached to various underwater equipment such as undersea equipment and underwater vehicles having different shapes and positions of the center of gravity according to their purpose and the like, allows simply and reliably setting their posture in water (basic posture), is excellent in versatility, is not only excellent in posture stability since, when the posture inclines under the effect and the like of tidal currents and pulsating currents, a moment to restore the posture to its original posture naturally acts, but is also capable of easily changing the posture as needed, and also is capable of stably controlling the posture even in the presence of complicated tidal currents and pulsating currents, and is excellent in reliability, stability, and certainty of posture control, and further provide a diving apparatus which, by including the underwater posture stabilization system, allows considerably reducing the man-hours regarding design for posture stabilization in stand-alone underwater equipment, allows downsizing and weight reduction of the body of the underwater equipment, and is excellent in stability of an underwater posture, and efficiency of a diving operation.

Solution to Problem

An underwater posture stabilization system and a diving apparatus equipped with the same of the present invention have the following configurations in order to solve the conventional problems described above.

An underwater posture stabilization system according to a first aspect of the present invention, which is an underwater posture stabilization system to be attached to various underwater equipment such as submersibles, underwater robots, and scuba diving equipment to be used for imaging and exploration in water and at the bottom of seas and oceans, rivers, lakes and marshes, dams, etc., ship bottom surveys, and the like, includes a frame to be attached to an apparatus body of the underwater equipment, a pair of sliding portions arranged so as to be freely movable back and forth on both side portions of the frame, a support member freely movable up and down which is fixed at a lower end portion thereof to each sliding portion, and arranged upward or obliquely upward, and a floating body arranged at a tip or longitudinally in the middle of each support member.

With this configuration, the following effects are obtained.

(1) By including the frame to be attached to the apparatus body of underwater equipment, the underwater posture stabilization system can be simply attached to the apparatus body of existing various underwater equipment without including posture control means to stabilize their underwater posture, and thus versatility is excellent.

(2) By including the pair of sliding portions arranged so as to be freely movable back and forth on both side portions of the frame, the support member freely movable up and down which is fixed at a lower end portion thereof to each sliding portion, and arranged upward or obliquely upward, and the floating body arranged at the tip or longitudinally in the middle of each support member, the underwater posture stabilization system, by moving the sliding portion back and forth and moving the support member up and down according to the position of the center of gravity of the apparatus body of the underwater equipment, can simply adjust the position in the back and forth direction and up and down direction of the floating body, is capable of setting the basic posture of the apparatus body before dropping into the water, and can adjust a restoring force when the posture in water is inclined under the effect and the like of waves based on the position of the floating body, and is thus excellent in versatility and usability.

(3) Since the support members on which the floating bodies are arranged are arranged upward or obliquely upward from the sliding portions on both side portions of the frame, by attaching the underwater posture stabilization system to the apparatus body of the diving apparatus or the like, the metacenter height can be freely adjusted to locate the center of buoyancy higher than the center of gravity so as to make the buoyancy act from above both sides of the apparatus body, and when the apparatus as a whole inclines under the effect and the like of tidal currents and pulsating currents, a moment (restoring force) for restoring the inclination largely acts, so that a stable posture of the apparatus body can always be maintained, and thus the posture stability is excellent.

(4) Since the underwater posture stabilization system is not for controlling the posture by jetting a fluid or rotating a thruster based on information of an inclinometer or an inertial sensor, a stable posture can be maintained even in the presence of complicated tidal currents and pulsating currents, and therefore, the underwater posture stabilization system can be used not only in lakes and marshes, dams, etc., with a small and gentle current, but also in seas and oceans, rivers, etc., and thus versatility is excellent.

(5) Regardless of the shape, size, etc., of the apparatus body of the underwater equipment, it suffices to carry out design and position setting of the floating body in consideration of the positional relationship between the center of gravity and center of buoyancy of the apparatus body, and since it is not necessary to consider the position of the center of gravity while designing apparatus bodies and complex posture control systems individually for each underwater equipment, the man-hours regarding design for posture stabilization in the underwater equipment can be considerably reduced to improve the freedom of design and mass productivity of the underwater equipment.

(6) Since the underwater posture stabilization system, when attached to a submersible, can keep the angle (posture) of the apparatus body in water constant due to the buoyancy and position of the floating body, it is not necessary for the apparatus body to be mounted with an angle control device or the like including a control weight, so that the apparatus body can be reduced in size and weight and multi-functionalized.

(7) By the floating bodies being arranged on both side portions of the frame, when the underwater posture stabilization system is attached to the apparatus body, the two left and right floating bodies and the apparatus body reach a state like a balancing toy turned upside down, and when the apparatus body shakes to deviate from the center, since the metacenter height can be set high, the apparatus body is drawn back to the center due to buoyancy applied to the floating bodies, so that a stable posture can be maintained. Particularly, when the support members are arranged obliquely upward, the floating bodies can be made to overhang at both lateral sides of the apparatus body, and shaking of the apparatus body slowly occurs, so that the posture stability can be increased.

(8) In an ordinary underwater equipment, it is necessary, when components such as a camera, a sensor, a thruster equipped on the apparatus body have been replaced, to perform balance adjustment by readjusting the center of gravity and center of buoyancy of the apparatus body, but since the floating body is arranged on the frame via the sliding portion that is freely movable back and forth and the support member that is freely movable up and down, the metacenter height can be freely adjusted only by adjusting the position in the back and forth direction and height direction of the floating body by moving the sliding portion back and forth and moving the support member up and down, the center of gravity and center of buoyancy can be changed to easily perform balance adjustment in terms of the front and rear and the left and right, and thus versatility and stability of posture control is excellent.

Here, as the apparatus body, a submersible, an underwater robot, scuba diving equipment, or the like is used.

As the submersible, either a tethered submersible connected to a mother ship or an untethered submersible capable of independently diving can be used. The tethered and untethered submersibles each include manned and unmanned types, either of which can be used. The submersible, an image of an underwater imager mounted on which can be observed while the submersible is remotely operated, includes a floating body, and can thus easily maintain horizontal balance to ease handling. Moreover, even when disturbances such as tidal currents act or a wrong operation is made, since the submersible includes a floating body, the submersible is less likely to spin around an axis in the forward direction so as to prevent an accident from occurring.

As the floating body, one formed so as to have a specific gravity of less than 1 is used. For example, a structure for which a gas such as air is filled inside of a pressure hull, a structure for which the inside of a pressure hull is depressurized to vacuum or the like, a structure for which a synthetic resin such as styrene foam or urethane foam having independent air bubbles or the like is filled or stored inside of a pressure hull, a structure for which hollow glass beads or synthetic resin beads are cured with a synthetic resin or the like and stored inside of a pressure hull, or the like can be used.

The floating body may be directly attached to a support member of a reinforcing bar, a steel bar, a steel material such as H-shaped steel, I-shaped steel, or L-shaped steel, a pipe material such as a stainless steel pipe, or the like, and can also be connected to the support member by a mooring member such as a steel wire such as a wire or a stainless steel wire, a chain, a rope, or the like. Moreover, the mooring member may be used as a support member so as to connect the sliding portion and the floating body therebetween. By attaching a frame around the apparatus body, the apparatus body and the floating body can be disposed separated from each other. The floating bodies are arranged at least one each on both side portions of the frame, but the number of floating bodies can be appropriately selected according to the shape, size, and the like of the diving apparatus. For example, a floating body can be added to a front side or a rear side of the middle of two left and right floating bodies, or a floating body can be added to a front side or a rear side of each of the two left and right floating bodies.

By arranging the support member in a manner projecting obliquely upward from the frame, the floating body can be arranged overhanging lateral to the apparatus body. When the floating body is moored by a mooring member such as a wire, by fixing a terminal end of the mooring member to the support member arranged so as to overhang from the apparatus body, buoyancy acts on the floating body in water to draw the mooring member upward, so that the floating body can be arranged above the apparatus body, and in a manner overhanging lateral to the apparatus body.

The frame as well as the support member can be formed of a reinforcing bar, a steel bar, a steel material such as H-shaped steel, I-shaped steel, or L-shaped steel, a pipe material such as a stainless steel pipe, or the like. A sliding portion which can be fixed by use of a fastening member such as a bolt capable of freely detachably fixing to a designated point of the frame, and particularly, is slidable along the longitudinal direction of the frame is suitably used. When the frame is formed of a columnar or cylindrical steel or pipe material, the sliding portion formed in a cylindrical shape may be inserted outside the frame, and fixed to a desired position by screwing or pin fitting. Moreover, a guide portion such as a projection or a recess may be formed along the longitudinal direction of the frame, and a fitting portion such as a recess or a projection may be formed on the sliding portion so as to be fitted to the guide portion of the frame. Alternatively, a freely extendable and retractable piston cylinder or the like may be arranged as a sliding portion on the frame, and a support member may be arranged at its tip (moving end) side. By the sliding portion itself extending and retracting, the support member supporting the floating body can be moved back and forth. In addition, an engaging portion that is engaged and fixed so as to be freely attachable and detachable with respect to underwater equipment or a submersible is provided on front and rear frames perpendicular to the longitudinal direction of the frame.

It suffices that the support member can move the floating body up and down, and for the attaching position of the floating body, not only the tip of the support member, but an arbitrary position longitudinally in the middle can also be selected. Moreover, the support member may be fixed by use of a fastening member such as a bolt capable of freely detachably fixing to a designated point of one member the other member and formed so as to be freely movable up and down, and the support member itself may be formed of a piston cylinder or linkage that is freely extendable and retractable in the longitudinal direction. In addition, when the floating body is moored at the tip or in the middle of the support member by use of a mooring member or when a mooring member is used as a support member for mooring the floating body to the sliding portion, a mechanism such as a reel device is used to thereby reel and unreel the mooring member so as to move the floating body up and down, allowing expanding the range of movement in the height direction of the floating body.

An invention according to a second aspect of the present invention is the underwater posture stabilization system according to the first aspect, including a forward/rearward movement drive section for moving each sliding portion back and forth and/or an up/down movement drive section for moving each support member up and down.

With this configuration, in addition to the effects obtained in the first aspect, the following effects are obtained.

(1) By including the forward/rearward movement drive section that moves each sliding portion back and forth and/or the up/down movement drive section that moves each support member up and down, the underwater posture stabilization system can freely adjust the position in the back and forth direction and the position in the height direction of the floating body even in water by an external operation to freely adjust the metacenter height, and can simply control the underwater posture by tilting in the back and forth direction or turning around the central axis the apparatus body together with the frame as needed, and is capable of making the imaging position and imaging direction by a camera, a video camera, or the like mounted on the apparatus body variable to conduct a detailed survey, and is thus excellent in versatility and operability of posture control and workability and reliability of a survey.

(2) During diving and during high-speed traveling, the underwater posture stabilization system can draw, by the up/down movement drive section, the floating body closer to the frame (apparatus body) so as to be less likely to become a resistance to perform quick movement, and during observation by imaging or the like, can select the position of the floating body, by the forward/rearward movement drive section or the up/down movement drive section, according to the center of gravity or the like of the apparatus body, to retain a desired posture, and is thus excellent in versatility and certainty of posture control in water.

Here, for the forward/rearward movement drive section and up/down movement drive section, according to the configuration of the foregoing sliding portion and support member, a drum cam, a belt drive, a rope drive, a chain drive, screws, a piston cylinder, various linkages, a motor, and the like may be used in combination. The drive sections may be ones that move the position of the sliding portion and support member, or may be ones that extend and retract the sliding portion and support member themselves.

An invention according to a third aspect of the present invention is the underwater posture stabilization system according to the first or second aspect, including a turning drive section for turning the sliding portion or the support member with respect to the frame.

With this configuration, in addition to the effects obtained in the first or second aspect, the following effects are obtained.

(1) Since the underwater posture stabilization system includes the turning drive section that turns the sliding portion or the support member with respect to the frame, the angle created by the left and right floating bodies can be freely adjusted even in water by an external operation, and the distance in the height direction between the apparatus body and the floating body and the space between the floating bodies can be changed to reduce the effect of tidal currents and pulsating currents and reduce the resistance during diving and during high-speed traveling, and the underwater posture stabilization system is thus excellent in versatility and operability of posture control and movement control.

(2) When there is provided the effect of tidal currents and pulsating currents even when the floating body is moved upward by the support member, the space (angle created) between the floating bodies can be expanded by the turning drive section to make the floating bodies overhang to the left and right so that shaking is suppressed, and when diving or high-speed traveling is performed, the space (angle created) between the floating bodies can be narrowed by the turning drive section to reduce resistance so that the moving speed is increased, and it is possible to perform further detailed posture control in combination with a forward/rearward movement by the sliding portion and/or an up/down movement by the support member, and the underwater posture stabilization system is thus excellent in versatility and stability of posture control.

Here, it suffices that the turning drive section can turn the sliding portion or the support member with respect to the frame. For example, one that turns a gear wheel by a motor to turn the sliding portion or the support member according to the amount of turn thereof, one that turns the support member around the frame by extension and retraction of the piston cylinder, and the like are suitably used. In terms of the range of movement of the sliding portion or the support member, one that can turn each floating body in a range from the horizontal direction outside the frame to the vertical direction above the frame is preferable.

An invention according to a fourth aspect of the present invention is the underwater posture stabilization system according to any one of the first to third aspects, in which a gyro stabilizer is provided inside of the floating body.

With this configuration, in addition to the effects obtained in any one of the first to third aspects, the following effects are obtained.

(1) Since a gyro stabilizer is provided inside of the floating body, a torque due to shaking occurs in the apparatus body, and also simultaneously acts on the gyro stabilizer provided inside of the floating body, and precession occurs to slowly tilt the angular momentum. At this time, the center of gravity of the gyro rotor moves in the opposite direction to restore the posture of the frame to a position in the horizontal direction by a torque due to gravity, so that the stability can further be increased. Particularly, when performing imaging by the apparatus body equipped with the underwater posture stabilization system during low-speed traveling and during suspension, slight shaking of the apparatus body and blurring can be suppressed, and a clear image with a high resolution can be obtained.

Here, as the gyro stabilizer, one for which a frame body is freely turnably fixed to a gyro support shaft fixed to a pressure hull of the floating body, and a gyro rotor is fixed to the frame body rotatably around a rotor shaft is used.

One to two gyro stabilizers can be provided inside per one floating body. When two gyro stabilizers are provided inside of one floating body, it is preferable to arrange the respective gyro support shafts in different directions. This is because fluctuations in the direction perpendicular to the respective gyro support shafts can be suppressed.

A diving apparatus according to a fifth aspect of the present invention includes an apparatus body and the underwater posture stabilization system according to any one of the first to fourth aspects attached to the apparatus body.

With this configuration, the following effects are obtained.

(1) By being equipped with the underwater posture stabilization system, the posture in water of the apparatus body can be stabilized, and the apparatus body can also be controlled as needed into a desired posture to perform high-speed diving, low-speed traveling, observation at the bottom of a body of water, ship bottom, and the like, imaging by a camera or a video camera, and the like, and the diving apparatus is thus excellent in stability, operability, and versatility of posture control in water and workability and reliability of a survey.

An invention according to a sixth aspect of the present invention is the diving apparatus according to the fifth aspect, including a flow direction detecting section arranged in an imaging range of an underwater imager of the apparatus body.

With this configuration, in addition to the effects obtained in the fifth aspect, the following effects are obtained.

(1) Since the direction in which the apparatus body travels, the direction of tidal currents, or the like can be detected by the flow direction detecting section to confirm this while viewing an image of the underwater imager, by handling the diving apparatus according to the flow direction of tidal currents while viewing an image of the underwater imager, controllability and posture stability can be improved.

Here, as the flow direction detecting section, an electromagnetic sensor may also be used, but a flag or the like which changes in direction depending on the flow direction is suitably used. This is because a flag allows simply visually recognizing the flow direction and has excellent durability.

Advantageous Effects of Invention

As in the above, by the underwater posture stabilization system and the diving apparatus equipped with the same of the present invention, the following advantageous effects are obtained.

By the invention according to the first aspect, (1) An underwater posture stabilization system excellent in versatility which can be simply attached to the apparatus body of existing various underwater equipment without including posture control means to stabilize their underwater posture can be provided.

(2) An underwater posture stabilization system excellent in versatility and usability which, by only moving the sliding portion back and forth and moving the support member up and down according to the position of the center of gravity of the apparatus body of the underwater equipment, can simply adjust the position in the back and forth direction and up and down direction of the floating body, allowing setting the basic posture of the apparatus body before dropping into the water can be provided.

(3) An underwater posture stabilization system excellent in posture stability which, by only being attached to the apparatus body of the diving apparatus or the like, can locate the center of buoyancy higher than the center of gravity of the apparatus body to make the buoyancy act from above both sides of the apparatus body, and when the apparatus body inclines under the effect and the like of tidal currents and pulsating currents, generates a moment for restoring the inclination to always maintain a stable posture of the apparatus body can be provided.

(4) An underwater posture stabilization system excellent in versatility which, since not being for controlling the posture by jetting a fluid or rotating a thruster based on information of an inclinometer or an inertial sensor, can maintain a stable posture even in the presence of complicated tidal currents and pulsating currents, and therefore can be used not only in lakes and marshes, dams, etc., with a small and gentle current, but also in seas and oceans, rivers, etc., can be provided.

(5) An underwater posture stabilization system excellent in mass productivity which, since it is not necessary to design complex control systems individually for each underwater equipment such as a diving apparatus, it suffices to design the floating body in consideration of the positional relationship between the center of gravity and center of buoyancy of the apparatus body regardless of the shape, size, etc., of the apparatus body, allows considerably reducing the man-hours regarding design for posture stabilization can be provided.

(6) An underwater posture stabilization system which, when attached to a submersible, can keep the angle (posture) of the apparatus body in water constant due to the buoyancy and position of the floating body, and thus allows eliminating an angle control device including a control weight from the apparatus body so as to reduce the apparatus body in size and weight can be provided.

(7) An underwater posture stabilization system for which, when this is attached to the apparatus body, the two left and right floating bodies and the apparatus body reach a state like a balancing toy turned upside down, and when the apparatus body shakes to deviate from the center, the apparatus body is drawn back to the center due to buoyancy applied to the floating bodies, so that a stable posture can be maintained, and particularly, by making the floating bodies overhang at both lateral sides of the apparatus body, shaking of the apparatus body slowly occurs, so that the posture stability can be increased can be provided.

(8) An underwater posture stabilization system excellent in versatility and stability of posture control which, even when components such as a camera, a sensor, a thruster equipped on the apparatus body have been replaced, by only adjusting the position of the floating body by use of the sliding portion and the support member, can change the center of gravity and center of buoyancy to easily perform balance adjustment in terms of the front and rear and the left and right can be provided.

By the invention according to the second aspect, in addition to the effects of the first aspect, (1) An underwater posture stabilization system excellent in versatility and operability of posture control and workability and reliability of a survey which, by operating the forward/rearward movement drive section and the up/down movement drive section to move each sliding portion back and forth and move the support member up and down, can freely adjust the position in the back and forth direction and the position in the height direction of the floating body even in water, can simply control the underwater posture by tilting in the back and forth direction or turning around the central axis the apparatus body together with the frame as needed, and is capable of making the imaging position and imaging direction by a camera, a video camera, or the like mounted on the apparatus body variable to conduct a detailed survey can be provided.

(2) An underwater posture stabilization system excellent in versatility and certainty of posture control in water which, during diving and during high-speed traveling, by the up/down movement drive section, can draw the floating body closer to the frame (apparatus body) so as to be less likely to become a resistance to perform quick movement, and during observation by imaging or the like, by the forward/rearward movement drive section or the up/down movement drive section, can select the position of the floating body to retain a desired posture according to the center of gravity or the like of the apparatus body can be provided.

By the invention according to the third aspect, in addition to the effects of the first or second aspect, (1) An underwater posture stabilization system excellent in versatility and operability of posture control and movement control which, by operating the turning drive section, can freely adjust the angle created by the left and right floating bodies even in water, and can change the distance in the height direction between the apparatus body and the floating body and the space between the floating bodies to reduce the effect of tidal currents and pulsating currents and reduce the resistance during diving and during high-speed traveling can be provided.

(2) An underwater posture stabilization system excellent in versatility and stability of posture control which is capable of performing further detailed posture control in combination of a forward/rearward movement of the floating body by the sliding portion and/or an up/down movement of the floating body by the support member and an angle adjustment between the floating bodies by the turning drive section can be provided.

By the invention according to the fourth aspect, in addition to the effects of any one of the first to third aspects, (1) An underwater posture stabilization system which, since a torque due to shaking occurs in the apparatus body and also simultaneously acts on the gyro stabilizer provided inside of the floating body, and the center of gravity of the gyro rotor moves to thereby restore the posture of the apparatus body to a position in the horizontal direction, is further excellent in stability can be provided.

By the invention according to the fifth aspect, (1) A diving apparatus excellent in stability, operability, and versatility of posture control in water and the workability and reliability of a survey which, by an underwater posture stabilization system, can simply set the basic posture in water of the apparatus body, is also less likely to receive the effect of tidal currents and pulsating currents, and can not only stabilize the posture, but can also control as needed the apparatus body into a designated posture to perform high-speed diving, low-speed traveling, observation at the bottom of a body of water, ship bottom, and the like, imaging by a camera or a video camera, and the like can be provided.

By the invention according to the sixth aspect, in addition to the effects of the fifth aspect, (1) A diving apparatus excellent in controllability and posture stability can be provided, since the direction in which the apparatus body travels, the direction of tidal currents, or the like can be detected by the flow direction detecting section to confirm this while viewing an image of the underwater imager, by handling the diving apparatus according to the flow direction while viewing an image of the underwater imager.

DESCRIPTION OF EMBODIMENTS

Hereinafter, the best mode for carrying out the present invention will be described with reference to the drawings.

Embodiment 1

Figure 1:
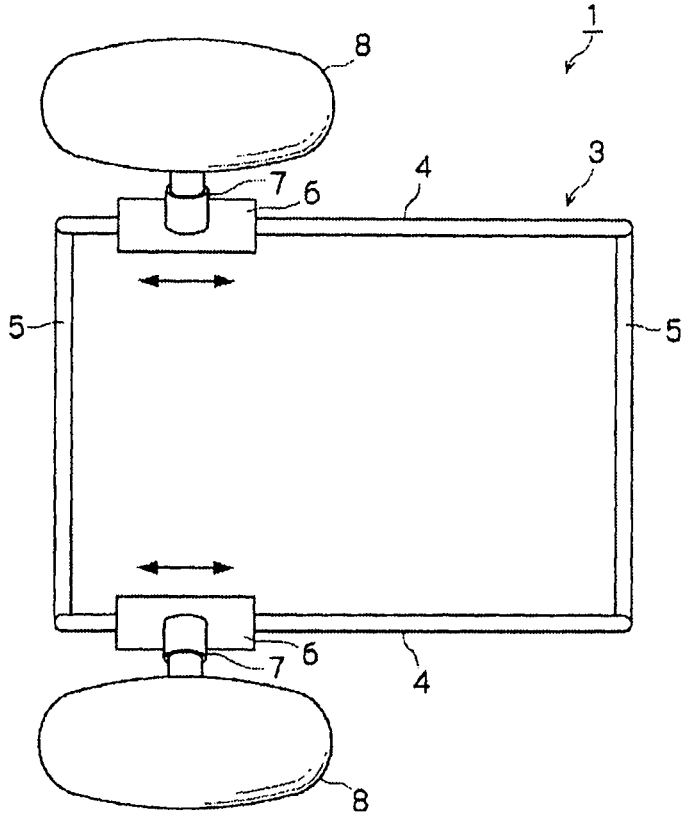
FIG. 1 is a plan view of an underwater posture stabilization system in Embodiment 1.
Figure 2:
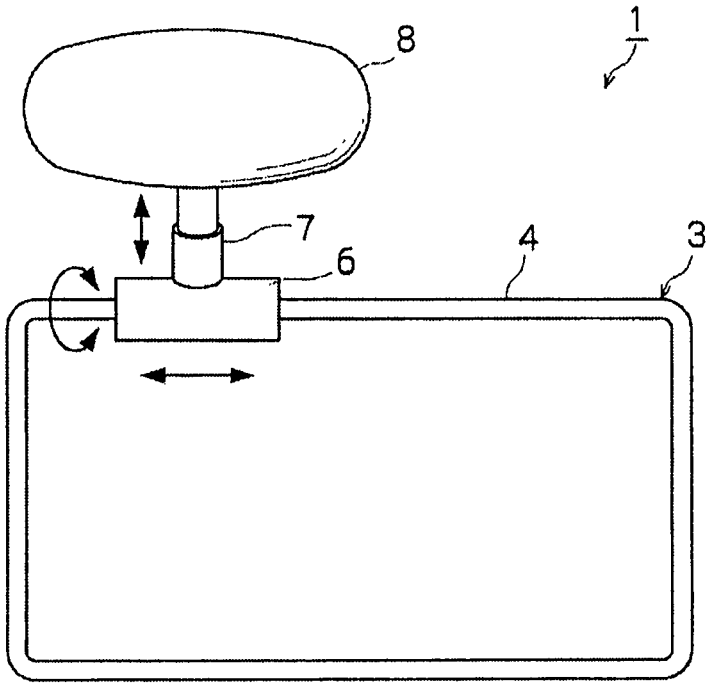
FIG. 2 is a side view of the underwater posture stabilization system in Embodiment 1.
Figure 3:
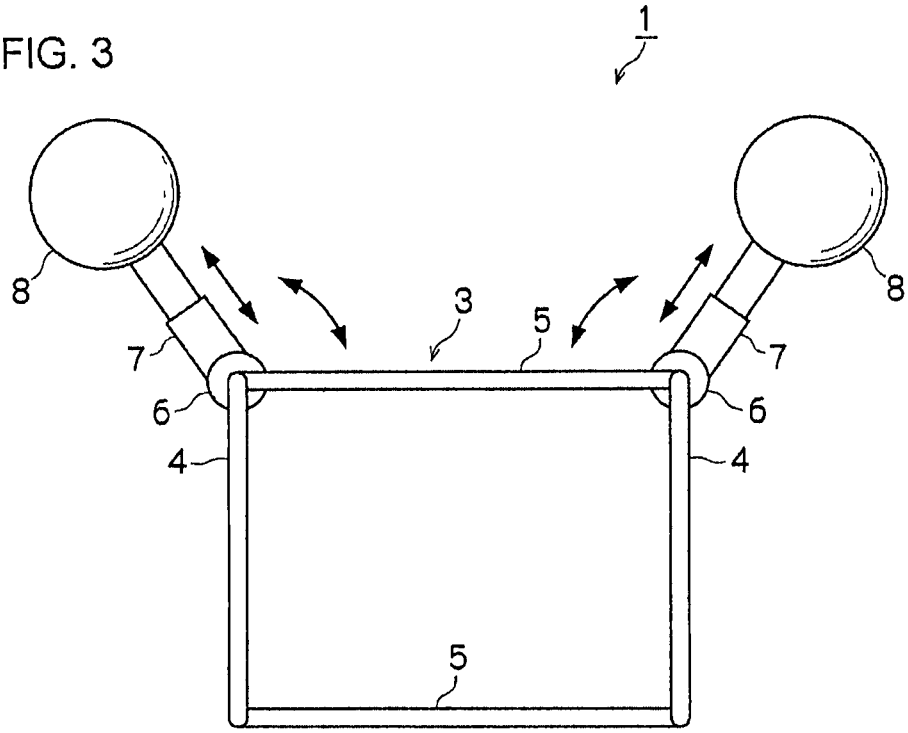
FIG. 3 is a front view of the underwater posture stabilization system in Embodiment 1.

FIG. 1 is a plan view of an underwater posture stabilization system in Embodiment 1 of the present invention, FIG. 2 is a side view of the underwater posture stabilization system in Embodiment 1, and FIG. 3 is a front view of the underwater posture stabilization system in Embodiment 1.

In FIG. 1, FIG. 2, and FIG. 3, reference sign 1 denotes an underwater posture stabilization system in Embodiment 1 of the present invention, reference sign 3 denotes a frame of the underwater posture stabilization system 1 arranged around an apparatus body of a diving apparatus or the like, fixed at a designated portion thereof to the apparatus body, and mounted with an environmental sensor (not shown) or the like, reference sign 4 denotes a side frame of the frame 3 formed in a substantially rectangular shape and arranged at both sides of the apparatus body, reference sign 5 denotes a horizontal beam of the frame 3 to connect the side frames 4, 4, reference sign 6 denotes a sliding portion arranged so as to be freely movable back and forth along an upper side portion of the side frame 4 at both side portions of the frame 3, and reference sign 7 denotes a support member freely movable up and down which is fixed at a lower end portion thereof to each sliding portion 6, and arranged obliquely upward. The support member 7 may be formed so as to be freely extendable and retractable by connecting a plurality of pipe materials such as stainless steel pipes, and driven by an up/down movement drive section (not shown), or the support member 7 itself may be formed of a piston cylinder including an up/down movement drive section. Reference sign 8 denotes a substantially cylindrical floating body arranged at a tip of the support member 7 substantially parallel to the longitudinal direction of the side frame 4 and arranged overhanging at both lateral sides of the side frame 4. The left and right floating bodies 8, 8 can be moved back and forth, moved up and down, and turned by the sliding portions 6, 6 and the support members 7, 7, respectively and independently, and be fixed at arbitrary positions. In addition, each floating body 8 is made turnable in a range from the horizontal direction outside the side frame 4 to the vertical direction above the side frame 4.

A diving apparatus equipped with the underwater posture stabilization system of Embodiment 1 configured as in the above will be described.

Figure 4:
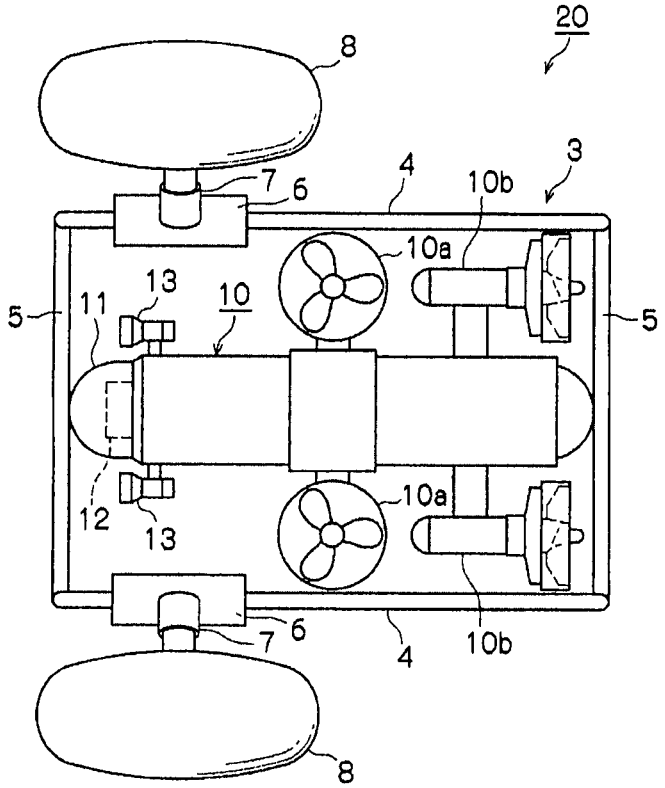
FIG. 4 is a plan view of a diving apparatus equipped with the underwater posture stabilization system in Embodiment 1.
Figure 5:
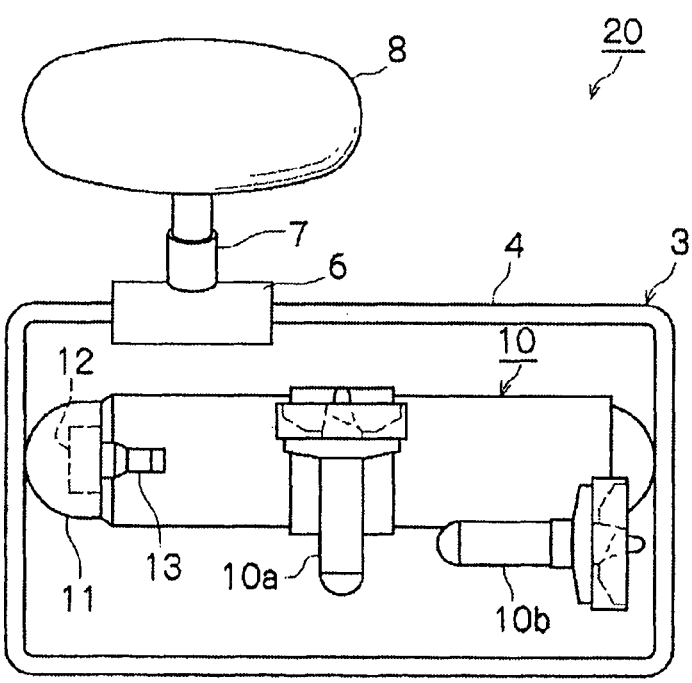
FIG. 5 is a side view of the diving apparatus equipped with the underwater posture stabilization system in Embodiment 1.
Figure 6:
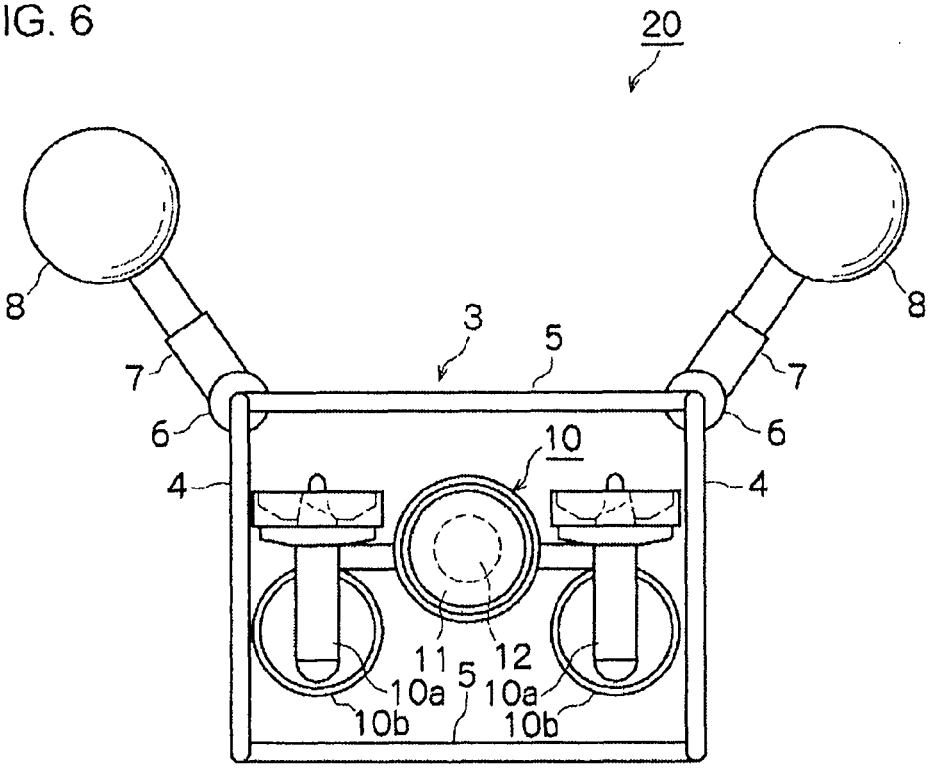
FIG. 6 is a front view of the diving apparatus equipped with the underwater posture stabilization system in Embodiment 1.

FIG. 4 is a plan view of a diving apparatus equipped with the underwater posture stabilization system in Embodiment 1, FIG. 5 is a side view of the diving apparatus equipped with the underwater posture stabilization system in Embodiment 1, and FIG. 6 is a front view of the diving apparatus equipped with the underwater posture stabilization system in Embodiment 1.

In FIG. 4, FIG. 5, and FIG. 6, reference sign 10 denotes an apparatus body of a diving apparatus 20 formed of a cylindrical pressure hull, reference sign 10*a* denotes a vertical thruster arranged lateral to substantially the center in the longitudinal direction of the apparatus body 10 to generate a thrust in the up and down direction (the height direction of the apparatus body 10), reference sign 10*b* denotes a horizontal thruster arranged laterally at the rear of the apparatus body 10 to generate a thrust in the back and forth direction (the longitudinal direction of the apparatus body 10), reference sign 11 denotes a transparent or semitransparent cover arranged at a front tip of the apparatus body 10, reference sign 12 denotes an underwater imager such as a video camera or a camera arranged inside of the apparatus body 10 and covered with the cover 11, reference sign 13 denotes an underwater light arranged at both front left and right sides of the apparatus body 10, and reference sign 20 denotes a diving apparatus serving as an unmanned submersible equipped with the underwater posture stabilization system 1 in the Embodiment 1. In addition, a front portion and rear portion of the frame 3 and the apparatus body 10 are engaged by engaging and fixing portions (not shown) that are freely attachable and detachable.

Next, the details of a floating body of the underwater posture stabilization system of Embodiment 1 will be described.

Figure 7:
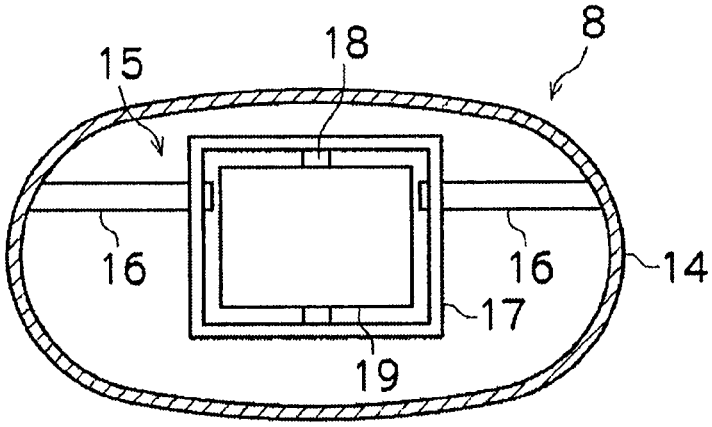
FIG. 7 is a sectional side view of a floating body of the underwater posture stabilization system in Embodiment 1.

FIG. 7 is a sectional side view of a floating body of the underwater posture stabilization system in Embodiment 1.

In FIG. 7, reference sign 14 denotes a pressure hull of the floating body 8 that is depressurized inside, reference sign 15 denotes a gyro stabilizer provided inside of the floating body 8, reference sign 16 denotes a gyro support shaft fixed at end portions thereof to front and rear wall portions of the pressure hull 14 of the floating body 8, reference sign 17 denotes a frame body fixed at upper lateral sides thereof to the gyro support shaft 16 so as to be freely turnable, reference sign 18 denotes a rotor shaft pivotally supported so as to be freely turnable on an upper portion and lower portion of the frame body 17, and reference sign 19 denotes a gyro rotor having a center of gravity located further at a lower side than the gyro support shaft 16, for rotating inside of the frame body 17 around the rotor shaft 18. The gyro rotor 19 can be rotated at a high speed by using a battery (not shown) stored in the apparatus body 10 as a power supply.

A method for using the diving apparatus equipped with the underwater posture stabilization system in Embodiment 1 of the present invention configured as in the above will be described in the following.

The diving apparatus 20 is mounted with ballast to lower (dive) into water, and when the diving apparatus 20 has lowered to a designated depth, the mounted ballast is dropped little by little to thereby obtain a neutral buoyancy. By using a buoyancy control device (not shown) mounted on the apparatus body 10, the buoyancy can be further controlled. Once a neutral buoyancy is obtained, by actuating the vertical thruster 10*a* and the horizontal thruster 10*b* while viewing an image imaged by the underwater imager 12 on the water, the diving apparatus 20 can be remotely operated so as to travel in water.

For observing in detail a designated place in water based on an image of the underwater imager 12 or conducting a water quality study or the like by an environmental sensor, the support member 7 is extended to make the floating body 8 largely overhang at both lateral sides of the apparatus body 10. Even when an external force to rotate the apparatus body 10 around the axis center acts under the effect of waves and the like, by keeping the space between the floating body 8 and the apparatus body 10 wide, a moment generated by the floating body 8 serves as a large restoring force for restoring the apparatus body 10 from inclination, and can attenuate shaking in a short time to make the apparatus body 10 statically determine, and the underwater posture stabilization system is thus excellent in posture stability. As a result, the diving apparatus 20 can be kept still to securely observe and survey the designated place in a short time.

Moreover, the sliding portion 6 can be moved to the rear of the side frame 4 of the frame 3 to lower the bow, and keep the apparatus body 10 inclined forward, for performing imaging. As needed, the gyro rotor 19 provided inside the floating body 8 is rotated at a high speed.

After the observation, survey, or the like ends, the support member 7 is retracted to draw the floating body 8 near the apparatus body 10, and the rotation of the gyro rotor 19 is also stopped. By dropping the remaining mounted ballast to the bottom of a body of water, the diving apparatus 20 is raised.

Since the underwater posture stabilization system in Embodiment 1 of the present invention and the diving apparatus equipped with the same have been configured as in the above, the following effects are obtained.

(1) By including the frame 3 to be attached to the apparatus body 10 of underwater equipment, the underwater posture stabilization system can be simply attached to the apparatus body 10 of existing various underwater equipment without including posture control means to stabilize their underwater posture, and is thus excellent in versatility.

(2) By including the pair of sliding portions 6 arranged so as to be freely movable back and forth on the side frames 4 on both side portions of the frame 3, the support member 7 freely movable up and down which is fixed at a lower end portion thereof to each sliding portion 6, and arranged obliquely upward, and the floating body 8 arranged at the tip of each support member 7, the underwater posture stabilization system, by moving the sliding portion 6 back and forth and moving the support member 7 up and down according to the position of the center of gravity of the apparatus body 10 of the underwater equipment, can simply adjust the position in the back and forth direction and up and down direction of the floating body 8, allowing setting the basic posture of the apparatus body 10 before dropping into the water, and is thus excellent in versatility and usability.

(3) Since the support members 7 on which the floating bodies 8 are arranged are arranged obliquely upward from the sliding portions 6 on both side portions of the frame 3, by attaching the underwater posture stabilization system to the apparatus body 10 of the diving apparatus or the like, the center of buoyancy can be located higher than the center of gravity to make the buoyancy act from above both sides of the apparatus body 10, and when the apparatus as a whole inclines under the effect and the like of tidal currents and pulsating currents, a moment for restoring the inclination acts, so that a stable posture of the apparatus body 10 can always be maintained, and the underwater posture stabilization system is thus excellent in posture stability.

(4) Since the underwater posture stabilization system is not for controlling the posture by jetting a fluid or rotating a thruster based on information of an inclinometer or an inertial sensor, a stable posture can be maintained even in the presence of complicated tidal currents and pulsating currents, and therefore, the underwater posture stabilization system can be used not only in lakes and marshes, dams, etc., with a small and gentle current, but also in seas and oceans, rivers, etc., and is thus excellent in versatility.

(5) Regardless of the shape, size, etc., of the apparatus body 10 of the underwater equipment, it suffices to carry out design and position setting of the floating body 8 in consideration of the positional relationship between the center of gravity and center of buoyancy of the apparatus body 10, and since it is not necessary to design complex postural control systems individually for each underwater equipment, the man-hours regarding design for posture stabilization in the underwater equipment can be considerably reduced.

(6) Since the underwater posture stabilization system, when attached to a submersible, can keep the angle (posture) of the apparatus body 10 in water constant due to the buoyancy and position of the floating body 8, it is not necessary for the apparatus body 10 to be mounted with an angle control device or the like including a control weight, so that the apparatus body 10 can be reduced in size and weight.

(7) By the floating bodies 8 being arranged on both side portions of the frame 3, when the underwater posture stabilization system is attached to the apparatus body 10, the two left and right floating bodies 8 and the apparatus body 10 reach a state like a balancing toy turned upside down, and when the apparatus body 10 shakes to deviate from the center, the apparatus body 10 is drawn back to the center due to buoyancy applied to the floating bodies 8, so that a stable posture can be maintained. Particularly, when the support members 7 are arranged obliquely upward, the floating bodies 8 can be made to largely overhang at both lateral sides of the apparatus body 10, and shaking of the apparatus body 10 slowly occurs, so that the posture stability can be increased.

(8) It has conventionally been necessary, when components such as a camera, a sensor, a thruster equipped on the apparatus body 10 have been replaced, to perform balance adjustment by readjusting the center of gravity and center of buoyancy of the apparatus body 10, but since the floating body 8 of the underwater posture stabilization system 1 is arranged on the frame 3 via the sliding portion 6 that is freely movable back and forth and the support member 7 that is freely movable up and down, by only adjusting the position in the back and forth direction and height direction of the floating body 8 by moving the sliding portion 6 back and forth and moving the support member 7 up and down, the center of gravity and center of buoyancy can be changed to easily perform balancing in terms of the front and rear and the left and right, and the underwater posture stabilization system is thus excellent in versatility and stability of posture control.

(9) Since the gyro stabilizer 15 is provided inside of the floating body 8, a torque due to shaking occurs in the apparatus body 10, and also simultaneously acts on the gyro stabilizer 15 provided inside of the floating body 8 to restore the posture of the apparatus body 10 to a position in the horizontal direction by a torque due to a shift in the center of gravity of the gyro rotor 19, so that the stability can further be increased. Particularly, when performing imaging by the apparatus body 10 equipped with the underwater posture stabilization system 1 during low-speed traveling and during suspension, slight shaking of the apparatus body 10 and blurring can be suppressed, so that a clear image with a high resolution can be obtained.

(10) Since the inside of the pressure hull 14 of the floating body 8 provided inside with the gyro stabilizer 15 has been depressurized, resistance resulting from a rotation of the gyro rotor 19 can be reduced, so that a drain of a battery to rotate the gyro rotor 19 can be reduced.

(11) By being equipped with the underwater posture stabilization system 1, the underwater posture of the apparatus body 10 can be stabilized, and the apparatus body 10 can also be controlled as needed into a desired posture to perform high-speed diving, low-speed traveling, observation at the bottom of a body of water, ship bottom, and the like, imaging by a camera or a video camera, and the like, and the diving apparatus is thus excellent in stability, operability, and versatility of posture control in water and workability and reliability of a survey.

(12) Even without mounting on an apparatus body a control weight of an angle control device that has been indispensable for a conventional submersible, since the angle of the apparatus body 10 in water can be kept stable by the buoyancy of the floating body 8, it is not necessary to mount an angle control device including a control weight on the apparatus body, so that the apparatus body 10 can be reduced in size and weight. As a result, a lightweight and small-sized apparatus body 10 that can be carried also as aircraft baggage can be manufactured. When the apparatus body 10 can be reduced in size and weight, the floating body 8 that is designed in consideration of the balance between the center of gravity and center of buoyancy of the diving apparatus 20 can also be reduced in size. Accordingly, not only can the diving apparatus 20 be disassembled into the underwater posture stabilization system 1 and the apparatus body 10, but it becomes also possible to disassemble the underwater posture stabilization system 1 into the frame 3, the floating body 8, etc., separate from the apparatus body 10 functional modules such as a vertical thruster 10*a*, a horizontal thruster 10*b*, and an underwater light 13, carry these as aircraft baggage or the like to a site by a plurality of persons, and assemble and use these on the site, so that the applicability is remarkably excellent.

(13) By attaching the underwater posture stabilization system 1 to the apparatus body 10, and adjusting the buoyancy based on the position of the floating body 8, the diving apparatus 20 as a whole can be balanced, and thus it is not necessary to consider the balance (position of the center of gravity) while designing the apparatus body 10, the design time can be shortened without being limited in size, mass, arrangement, etc., of components of the respective portions, so that the freedom of design and mass productivity of the apparatus body 10 can be considerably improved.

Here, in the present embodiment, description has been given by using the diving apparatus 20 serving as an unmanned submersible, but the present invention is not limited hereto, and the same effects are obtained also in the case of an underwater robot, scuba diving equipment, and the like.

Moreover, in the present embodiment, description has been given for the case where the underwater imager 12 is mounted on the apparatus body 10, and the vertical thruster 10*a*, the horizontal thruster 10*b*, and the underwater light 13 are arranged on the apparatus body 10, but there is also a case where these are attached to the frame 3. The same effects are obtained also in this case.

Embodiment 2

Figure 8:
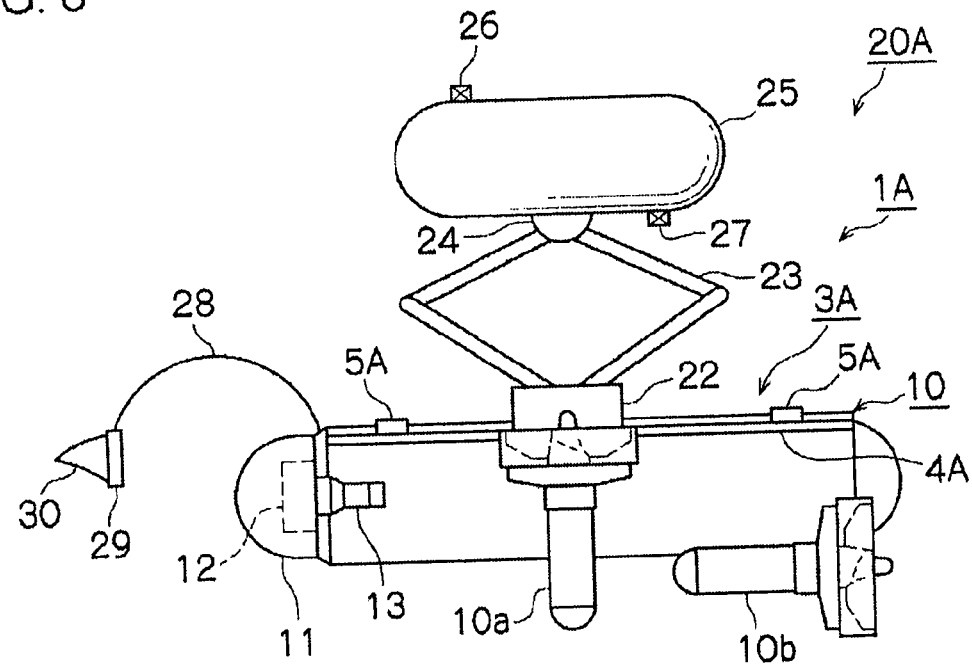
FIG. 8 is a plan view of a diving apparatus equipped with an underwater posture stabilization system in Embodiment 2.

FIG. 8 is a side view of a diving apparatus equipped with an underwater posture stabilization system in Embodiment 2 of the present invention. In addition, the same components as those described in Embodiment 1 will be denoted by the same reference signs, and description thereof will be omitted.

In the figure, reference sign 1A denotes an underwater posture stabilization system in Embodiment 2 of the present invention attached to an apparatus body 10 of a diving apparatus 20A, reference sign 3A denotes a frame of the underwater posture stabilization system 1A arranged on an upper surface of the apparatus body 10 of the diving apparatus 20A, reference sign 4A denotes a side guide frame of the frame 3A formed in a rail shape (projection) and arranged at both sides of the upper surface of the apparatus body 10 in parallel with the longitudinal direction of the apparatus body 10, reference sign 5A denotes a frame connecting portion formed in an arc shape along the outer periphery of the apparatus body 10, for connecting the left and right side guide frames 4A at the front and rear, reference sign 22 denotes a sliding portion arranged so as to be freely movable back and forth in the longitudinal direction of the side guide frame 4A of the frame 3A and having a built-in drive unit or the like of a support member 23 to be described later, reference sign 23 denotes a pantograph-type support member fixed at one end portion thereof to the sliding portion 22 and formed so as to be freely extendable and retractable to move a floating body 25 up and down, reference sign 24 denotes a fixing portion to which the other end portion of the support member 23 is fixed so as to be freely turnable, and reference sign 25 is a floating body formed of a hollow pressure hull and formed on a lower surface thereof with the fixing portion 24. The sliding port ion 22, the support member 23, the fixing portion 24, and the floating body 25 are provided also on the other side guide frame 4A. The apparatus body 10 is mounted with a liquefied gas cylinder (not shown) filled with high-pressure dimethylpropane, normal butane, or the like, and the liquefied gas cylinder is connected with the floating body 25 by piping (not shown). Reference sign 26 denotes a valve that opens and closes a pipe line (not shown) arranged on an upper surface of the floating body 25, reference sign 27 denotes a valve that opens and closes a pipe line (not shown) arranged at the bottom of the floating body 25, reference sign 28 denotes a detecting section support formed of a steel material, a rod material, or the like, fixed at one end portion thereof to a front portion of the apparatus body 10, and extended at a tip portion thereof to the front of a cover 11, reference sign 29 denotes a turnably fixed portion fixed to the tip portion of the detecting section support 28 so as to be freely turnable, and reference sign 30 denotes a flow direction detecting section formed of a flag fixed at a base portion thereof to the turnably fixed portion 29 and arranged in an imaging range of the underwater imager 12.

A method for using the diving apparatus in Embodiment 2 of the present invention configured as in the above will be described in the following.

The diving apparatus 20A is made to dive (lower) in water by mounting thereon ballast. By opening the valves 26, 27 in water, water is stored in the floating body 25. Since the buoyancy of the floating body 25 is accordingly reduced, diving (lowering) is smoothly performed. When the diving apparatus 21 has lowered to the vicinity of a designated depth, by introducing a vaporized gas from the liquefied gas cylinder into the floating body 25 with the valve 26 closed and the valve 27 open, the water in the floating body 25 is discharged from the valve 27. The valve 27 is closed when the water in the floating body 25 has been replaced with the vaporized gas. Accordingly, buoyancy is created in the floating body 25. Further, the buoyancy is controlled by dropping the ballast or using a buoyancy control device (not shown) to obtain a neutral buoyancy. Once a neutral buoyancy is obtained, by actuating the vertical thruster 10*a* and the horizontal thruster 10*b* while viewing an image imaged by the underwater imager 12 on the water, the diving apparatus 20A can be remotely operated so as to travel in water.

For observing in detail a designated place in water based on an image of the underwater imager 12 or conducting a water quality study or the like by an environmental sensor, the support member 23 is extended to locate the floating body 25 high above the apparatus body 10. Moreover, the sliding portion 22 can be moved to the rear of the apparatus body 10 along the side guide frame 4A of the frame 3A to lower the bow, and keep the apparatus body 10 inclined forward, for performing imaging.

After the observation, survey, or the like ends, the support member 23 is retracted to draw the floating body 25 near the apparatus body 10. By dropping the mounted ballast to the bottom of a body of water, the diving apparatus 20A is raised.

Since the underwater posture stabilization system in Embodiment 2 of the present invention and the diving apparatus equipped with the same have been configured as in the above, in addition to the effects described in Embodiment 1, the following effects are obtained.

(1) Since the liquefied gas cylinder connected with the floating body 25 is mounted on the apparatus body 10, and the valves 26, 27 are arranged on the upper surface and lower surface of the floating body 25, buoyancy can be created in the floating body 25 by introducing a vaporized gas from the liquefied gas cylinder into the floating body 25, to perform buoyancy control.

(2) Since the diving apparatus includes a flow direction detecting section 30 arranged in the imaging range of the underwater imager 12, the direction in which the apparatus body 10 travels, the direction of tidal currents, or the like can be detected by the flow direction detecting section 30 to handle the diving apparatus according to the flow direction while viewing an image of the underwater imager 12, and the diving apparatus is thus excellent in controllability and posture stability.

In the present embodiment, description has been given for the case where the flow direction detecting section 30 formed of a flag has been used, but there is also a case where a combination of a flag and a float is used. In this case, one end portion of the detecting section support 28 is fixed to a front lower side of the apparatus body 10 so that the flag can be visually recognized at a lower side of the imaging range.

Embodiment 3

Figure 9:
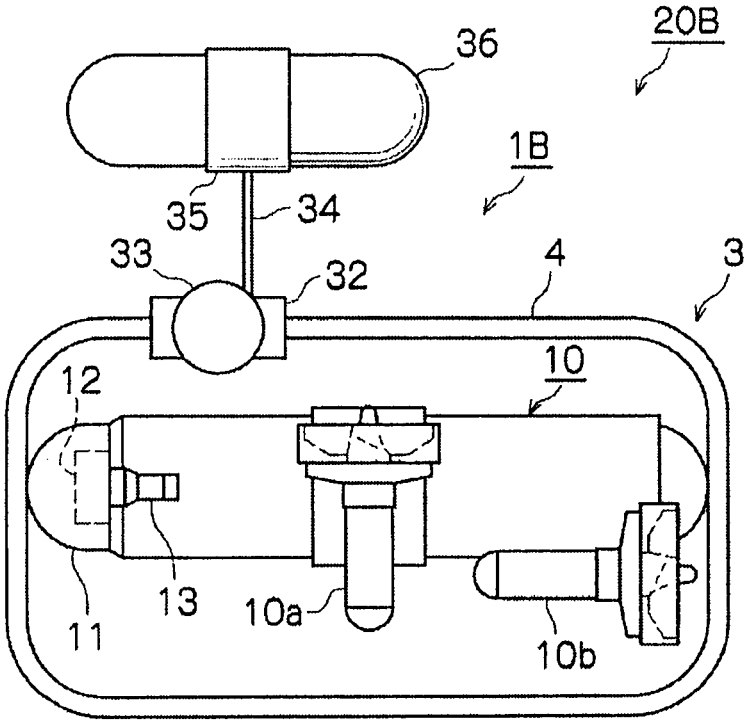
FIG. 9 is a side view of a diving apparatus equipped with an underwater posture stabilization system in Embodiment 3.

FIG. 9 is a side view of a diving apparatus equipped with an underwater posture stabilization system in Embodiment 3 of the present invention. In addition, the same components as those described in Embodiment 1 will be denoted by the same reference signs, and description thereof will be omitted.

In the figure, reference sign 1B denotes an underwater posture stabilization system in Embodiment 3 of the present invention attached to an apparatus body 10 of a diving apparatus 20B, reference sign 32 denotes a sliding portion arranged so as to be freely movable back and forth along an upper side portion of a side frame 4 at both side portions of a frame 3, for moving along the longitudinal direction of the apparatus body 10, reference sign 33 denotes a reel device fixed to the sliding portion 32, reference sign 34 denotes a mooring member serving as a support member using a wire or the like wound around the reel device 33, reference sign 35 denotes a fixing portion to which an end portion of the mooring member 34 is fixed, reference sign 36 denotes a floating body attached at substantially the center in the longitudinal direction thereof with the fixing portion 35, and arranged overhanging at both lateral sides of the apparatus body 10. The sliding portion 32, the reel device 33, the mooring member 34, the fixing portion 35, and the floating body 36 are provided also on the other side frame 4. The floating body 36 is formed of a structure for which a gas such as air is filled inside of a pressure hull, a structure for which the inside of a pressure hull is depressurized, a structure for which a synthetic resin such as styrene foam or urethane foam having independent air bubbles or the like is filled or stored inside of a pressure hull, a structure for which hollow glass beads or synthetic resin beads are cured with a synthetic resin or the like and stored inside of a pressure hull, or the like.

The diving apparatus in Embodiment 3 of the present invention configured as in the above, for observing in detail based on an image of the underwater imager 12 or conducting a water quality study or the like by an environmental sensor, actuates the reel device 33 to unreel the mooring member 34 and raise the floating body 36 to a high position, thereby allowing increasing the stability. After the observation, survey, or the like ends, the reel device 33 is actuated to reel the mooring member 34 so as to draw the floating body 36 near the apparatus body 10.

Since the diving apparatus in Embodiment 3 of the present invention has been configured as in the above, the same effects as those described in Embodiment 1 can be obtained.

Embodiment 4

Figure 10A:
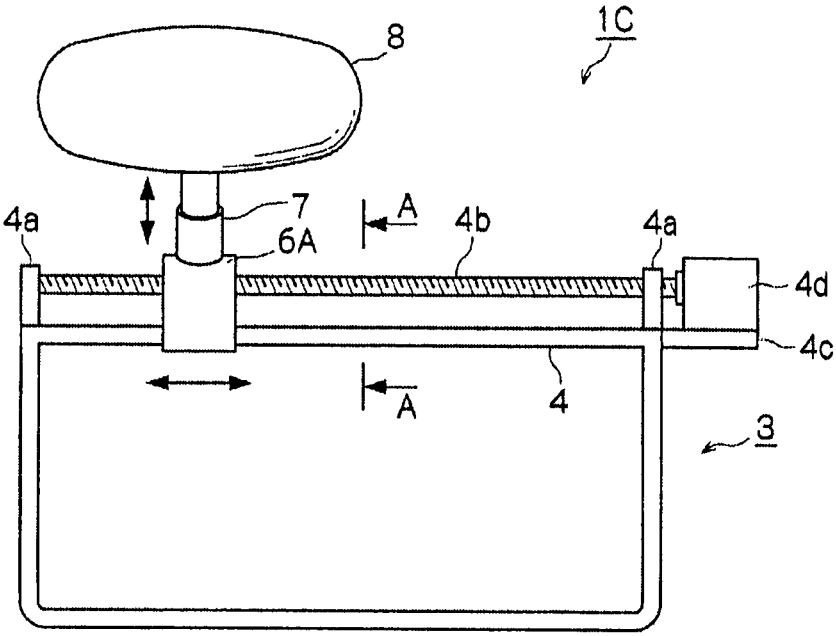
FIG. 10A is a side view of an underwater posture stabilization system in Embodiment 4.
Figure 10B:
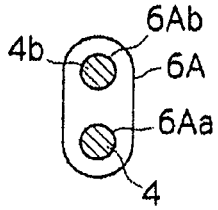
FIG. 10B is a sectional end view taken along an arrow line A-A.

FIG. 10A is a side view of an underwater posture stabilization system in Embodiment 4 of the present invention, and FIG. 10B is a sectional end view taken along an arrow line A-A. In addition, the same components as those described in Embodiment 1 will be denoted by the same reference signs, and description thereof will be omitted.

In FIG. 10A and FIG. 10B, reference sign 1C denotes an underwater posture stabilization system in Embodiment 4, reference sign 4*a* denotes a pivot support portion arranged on both-end upper portions of each side frame 4 of a frame 3, reference sign 4*b* denotes a screw arranged in parallel with an upper side of the side frame 4 and supported at both end portions thereof so as to be freely turnable by the pivot support portions 4*a*, 4*a*, reference sign 4*c* denotes a base portion arranged at one end of the upper side of each side frame 4, reference sign 4*d* denotes a forward/rearward movement drive section using a motor fixedly provided on the base portion 4*c*, for turning the screw 4*b*, reference sign 6A denotes a sliding portion that is guided by the upper side of the side frame 4 while moving back and forth along the screw 4*b*, reference sign 6Aa denotes a through-hole of the sliding portion 6A through which an upper side portion of the side frame 4 is inserted, and reference sign 6Ab denotes a female screw portion of the sliding portion 6A with which the screw 4*b* is screwed.

By driving the forward/rearward movement drive section 4*d*, the sliding portion 6A can be moved back and forth, so that the position in the back and forth direction of the floating body 8 can be freely adjusted. Moreover, the support member 7, as in Embodiment 1, can be moved up and down by an up/down movement drive section (not shown), so that the position in the up and down direction of the floating body 8 can be freely adjusted.

Since the underwater posture stabilization system in Embodiment 4 of the present invention has been configured as in the above, in addition to the effects obtained by the underwater posture stabilization system in Embodiment 1, the following effects are obtained.

(1) By including the forward/rearward movement drive section 4*d* that moves each sliding portion 6A back and forth and the up/down movement drive section that moves each support member 7 up and down, the underwater posture stabilization system can freely adjust the position in the back and forth direction and the position in the height direction of the floating body 8 even in water by an external operation, and can simply control the underwater posture by tilting in the back and forth direction or turning around the central axis the apparatus body together with the frame 3 as needed, and is capable of making the imaging position and imaging direction by a camera, a video camera, or the like mounted on the apparatus body variable to conduct a detailed survey, and thus is excellent in versatility and operability of posture control and workability and reliability of a survey.

(2) During diving and during high-speed traveling, the underwater posture stabilization system can draw, by the up/down movement drive section, the floating body 8 closer to the frame 3 (apparatus body) so as to be less likely to become a resistance to perform quick movement, and during observation by imaging or the like, can select the position of the floating body 8, by the forward/rearward movement drive section 4*d* or the up/down movement drive section, according to the center of gravity or the like of the apparatus body, to retain a desired posture, and is thus excellent in versatility and certainty of posture control in water.

Embodiment 5

Figure 11A:
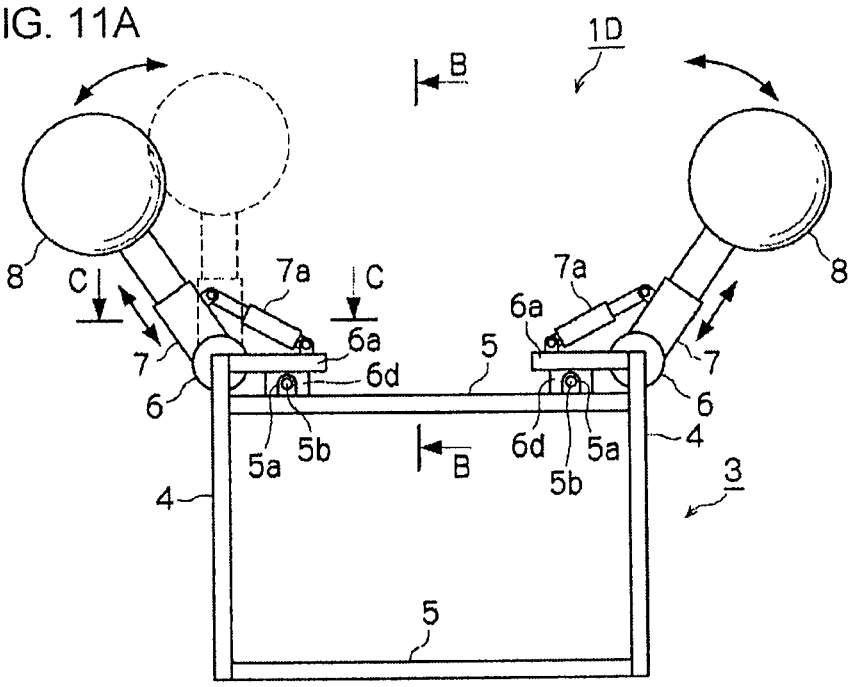
FIG. 11A is a front view of an underwater posture stabilization system in Embodiment 5.
Figure 11B:
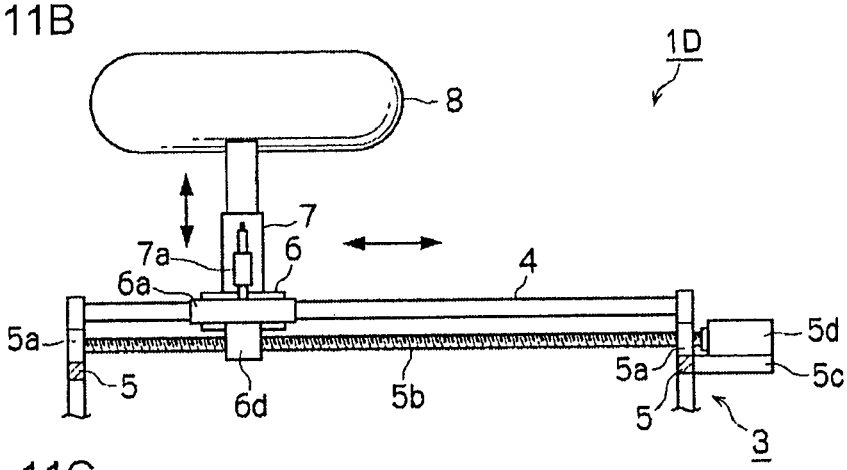
FIG. 11B is a sectional side view taken along an arrow line B-B.
Figure 11C:
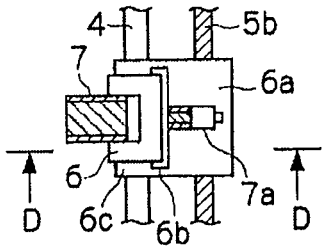
FIG. 11C is a sectional plan view showing the main part taken along an arrow line C-C.
Figure 11D:
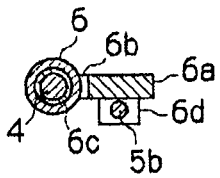
FIG. 11D is a sectional end view taken along an arrow line D-D.

FIG. 11A is a front view of an underwater posture stabilization system in Embodiment 5, FIG. 11B is a sectional side view taken along an arrow line B-B, FIG. 11C is a sectional plan view showing the main part taken along an arrow line C-C, and FIG. 11D is a sectional end view taken along an arrow line D-D. In addition, the same components as those described in Embodiment 1 will be denoted by the same reference signs, and description thereof will be omitted.

In FIG. 11A to FIG. 11D, reference sign 1D denotes an underwater posture stabilization system in Embodiment 5, reference sign 5*a* denotes a pivot support portion arranged on left and right upper surfaces of respective front and rear horizontal beams 5 that connect upper end sides of left and right side frames 4, reference sign 5*b* denotes a screw arranged in parallel with an upper side of the side frame 4 and supported at both end portions thereof so as to be freely turnable by the pivot support portions 5*a*, 5*a*, reference sign 5*c* denotes a base portion arranged at one end of the upper side of each side frame 4, reference sign 5*d* denotes a forward/rearward movement drive section using a motor fixedly provided on the base portion 5*c*, for turning the screw 5*b*, reference sign 6*a* denotes a sliding table portion that is guided by the upper side of the side frame 4 while moving back and forth together with a sliding portion 6 along the screw 5*b*, reference sign 6*b* denotes an opening portion formed in the sliding table portion 6*a*, reference sign 6*c* denotes a turnably support portion of the sliding table portion 6*a* that is inserted outside the upper side of the side frame 4 and inserted inside the sliding portion 6 to retain the sliding portion 6 so as to be freely turnable, reference sign 6*d* denotes a female screw forming portion of the sliding table portion 6*a* arranged on a bottom surface of the sliding table portion 6*a* and screwed with the screw 5*b*, and reference sign 7*a* denotes a turning drive section using a piston cylinder retained at one end thereof so as to be freely turnable on an upper surface of the sliding table portion 6*a* and retained at the other end thereof so as to be freely turnable on one side portion of a support member 7, for turning the support member 7.

By driving the forward/rearward movement drive section 5*d*, not only can the sliding portion 6 be moved back and forth together with the sliding table portion 6*a*, but by driving the turning drive section 7*a*, the support member 7 can also be turned together with the sliding portion 6 around the upper side of the side frame 4 of the frame 3 so as to freely adjust the angle created by the left and right floating bodies 8, 8. In addition, the support member 7, as in Embodiments 1 and 4, can be moved up and down by an up/down movement drive section (not shown), so that the position in the up and down direction of the floating body 8 can be freely adjusted.

Since the underwater posture stabilization system in Embodiment 5 of the present invention has been configured as in the above, in addition to the effects obtained by the underwater posture stabilization systems in Embodiments 1 and 4, the following effects are obtained.

(1) Since the underwater posture stabilization system includes the turning drive section 7*a* that turns the sliding portion 6 or the support member 7 with respect to the frame 3, the angle created by the left and right floating bodies 8 can be freely adjusted even in water by an external operation, and the distance in the height direction between the apparatus body and the floating body 8 and the space between the floating bodies 8 can be changed to reduce the effect of tidal currents and pulsating currents and reduce the resistance during diving and during high-speed traveling, and the underwater posture stabilization system is thus excellent in versatility and operability of posture control and movement control.

(2) When there is provided the effect of tidal currents and pulsating currents even when the floating body 8 is moved upward by the support member 7, the space (angle created) between the floating bodies 8 can be expanded by the turning drive section 7*a* to make the floating bodies 8 overhang to the left and right so that shaking is suppressed, and when diving or high-speed traveling is performed, the space (angle created) between the floating bodies 8 can be narrowed by the turning drive section 7*a* to reduce resistance so that the moving speed is increased, and it is possible to perform further detailed posture control in combination with a forward/rearward movement by the sliding portion 6 or an up/down movement by the support member 7, and the underwater posture stabilization system is thus excellent in versatility and stability of posture control.

INDUSTRIAL APPLICABILITY

The present invention relates to an underwater posture stabilization system for stabilizing the underwater posture of various underwater equipment such as submersibles, underwater robots, and scuba diving equipment to be used for imaging and exploration in water and at the bottom of seas and oceans, rivers, lakes and marshes, dams, etc., ship bottom surveys, and the like and a diving apparatus equipped with the same, and can provide an underwater posture stabilization system which, by being attached to various underwater equipment such as undersea equipment and underwater vehicles having different shapes and positions of the center of gravity according to their purpose and the like, allows simply and reliably setting their posture in water (basic posture), is excellent in versatility, is not only excellent in posture stability since, when the posture inclines under the effect and the like of tidal currents and pulsating currents, a moment to restore the posture to its original posture naturally acts, but is also capable of easily changing the posture as needed, and also is capable of stably controlling the posture even in the presence of complicated tidal currents and pulsating currents, and is excellent in reliability, stability, and certainty of posture control, and further provide a diving apparatus which, by including the underwater posture stabilization system, allows remarkably reducing the man-hours regarding design for posture stabilization in stand-alone underwater equipment, allows downsizing and weight reduction of the body of the underwater equipment, and is excellent in stability of an underwater posture, and efficiency of a diving operation.

REFERENCE SIGNS LIST

1, 1A, 1B, 1C, 1D Underwater posture stabilization system
3, 3A Frame
4 Side frame
4A Side guide frame
4*a*, 5*a* Pivot support portion
4*b*, 5*b* Screw
4*c*, 5*c* Base portion
4*d*, 5*d* Forward/rearward movement drive section
5 Horizontal beam
5A Frame connecting portion
6, 6A, 22, 32 Sliding portion
6Aa Through-hole
6Ab Female screw portion
6*a* Sliding table portion
6*b* Opening portion
6*c* Turnably support portion
6*d* Female screw forming portion
7, 23 Support member
7*a* Turning drive section
8, 25, 36 Floating body
10 Apparatus body
10*a* Vertical thruster
10*b* Horizontal thruster
11 Cover
12 Underwater imager
13 Underwater light
14 Pressure hull
15 Gyro stabilizer
16 Gyro support shaft
17 Frame body
18 Rotor shaft
19 Gyro rotor
20, 20A, 20B Diving apparatus
24, 35 Fixing portion
26, 27 Valve
28 Detecting section support
29 Turnably fixed portion
30 Flow direction detecting section
33 Reel device
34 Mooring member

The invention claimed is:

1. An underwater posture stabilization system configured to be attached to underwater equipment selected from the group consisting of submersibles, underwater robots, and scuba diving equipment, to be used for imaging and exploration in water and at the bottom of water, the water and bottom of water selected from the group consisting of seas, oceans, rivers, lakes, marshes, dams, and ship bottom surveys, said system comprising:

a frame to be attached to an apparatus body of the underwater equipment, the frame including at least a first side frame element and a second side frame element;

a first sliding portion and a second sliding portion, each sliding portion arranged so as to be movable back and forth along a longitudinal direction of the frame, the first and the second sliding portions being arranged respectively on the first side frame element and second side frame element;

a support member which is fixed at a lower end portion thereof to each sliding portion, and arranged at an upper end side thereof so as to project upward or obliquely upward from the sliding portion; and a floating body supported so as to be movable up and down by a respective one of each support member.

2. The underwater posture stabilization system according to claim 1, further comprising at least either (a) a forward/rearward movement drive section for moving each sliding portion in position along a longitudinal direction of the frame or causing each sliding portion itself to extend and retract or (b) an up/down movement drive section for causing each support member to extend and retract so as to move the floating body up and down.

3. The underwater posture stabilization system according to claim 1, wherein the first and second sliding portions are retained so as to be turnable on the respective first side frame element and second side frame element frames, said system further comprising a turning drive section for turning together with the sliding portion, the support member with respect to the frame.

4. The underwater posture stabilization system according to claim 1, wherein a gyro stabilizer is provided inside of the floating body.

5. A diving apparatus comprising an apparatus body and the underwater posture stabilization system according to claim 1 attached to the apparatus body.

6. The diving apparatus according to claim 5, comprising a flow direction detecting section arranged in an imaging range of an underwater imager of the apparatus body.

7. The underwater posture stabilization system according to claim 2, wherein the first and second sliding portions are retained so as to be turnable on the respective first side frame element and second side frame element frames, said system further comprising a turning drive section for turning together with the sliding portion, the support member with respect to the frame.

* * * * *

UNITED STATES PATENT AND TRADEMARK OFFICE

CERTIFICATE OF CORRECTION

PATENT NO. : 8,683,938 B2
APPLICATION NO. : 12/999443
DATED : April 1, 2014
INVENTOR(S) : Akihito Shoda et al.

It is certified that error appears in the above-identified patent and that said Letters Patent is hereby corrected as shown below:

In the Claims:

Column 22, line 33, change “frame element frames” to --frame element--; and

Column 22, line 49, change “frame element frames” to --frame element--.

Signed and Sealed this
Eighth Day of July, 2014

Michelle K. Lee

Michelle K. Lee
*Deputy Director of the United States Patent and Trademark Office*